United States Patent [19]

Halder et al.

[11] Patent Number: 4,825,634

[45] Date of Patent: May 2, 1989

[54] SUCTION TUBE FOR COLLECTING BROKEN ENDS OF YARN AT THE OUTLET OF A TEXTILE MACHINE

[75] Inventors: Ernst Halder, Waschenbeuren; Friedrich Dinkelmann, Rochberghausen; Robert Buder, Memmingen; Uwe Fuchs, Billigheim; Dieter Horak, Monchen-Gladbach; Hans-Heinz Schafer, Schwalmtal, all of Fed. Rep. of Germany

[73] Assignee: Zinser Textilmaschinen GmbH, Fed. Rep. of Germany

[21] Appl. No.: 132,392

[22] Filed: Dec. 15, 1987

[30] Foreign Application Priority Data

Dec. 15, 1986 [DE] Fed. Rep. of Germany ..... 3642820

[51] Int. Cl.[4] ..... D01H 5/68; D01H 5/66

[52] U.S. Cl. ..... 57/305; 19/263; 57/304

[58] Field of Search ..... 57/304, 305, 306, 300; 19/262–265

[56] References Cited

U.S. PATENT DOCUMENTS

| | | | |
|---|---|---|---|
| 2,522,250 | 9/1950 | Bechtler | 57/305 |
| 2,724,943 | 11/1955 | Furstenberg | 57/305 |
| 2,825,198 | 3/1958 | Krahschutz | 57/305 |
| 2,849,852 | 9/1958 | Jacobi et al. | 57/304 X |
| 2,956,389 | 10/1960 | Berberich et al. | 57/305 X |
| 3,251,100 | 5/1966 | Ingham, Jr. | 19/263 |
| 3,541,630 | 11/1970 | Barr, Jr. et al. | 19/263 X |

FOREIGN PATENT DOCUMENTS

| | | |
|---|---|---|
| 178048 | 3/1954 | Austria . |
| 1067714 | 4/1960 | Fed. Rep. of Germany . |
| 1273391 | 7/1968 | Fed. Rep. of Germany . |
| 2810037 | 10/1978 | Fed. Rep. of Germany . |
| 965216 | 2/1950 | France . |
| 39-16212 | 8/1964 | Japan . |
| 257367 | 3/1949 | Switzerland . |

*Primary Examiner*—John Petrakes

*Attorney, Agent, or Firm*—Shefte, Pinckney & Sawyer

[57] ABSTRACT

A suction tube for a fly frame, roving frame, ring spinning machine or the like for collecting broken ends of yarn at the outlet rollers of the machine. The suction tube is connected to a collection chamber through a flexible sealing sleeve that permits the suction tube to pivot between its operative and inoperative positions. The suction tube comprises a suction end disposed under the bottom roller of the outlet rollers that has a body portion formed with a suction opening therein, an opposite end connected to the flexible sealing sleeve, and a pair of side walls projecting upwardly from the suction end body portion toward the bottom roller and longitudinally beyond the suction opening on opposite sides of the yarn for confining the suction substantially to the bottom roller and the yarn path. The side walls also have upper edges which are arcuately shaped to correspond approximately to the shape of the bottom roller so that the upper edges will contact the bottom roller and space the suction tube from the roller when the suction tube is unintentionally forced upwardly toward the bottom roller, thereby preventing damage to the suction tube.

8 Claims, 1 Drawing Sheet

SUCTION TUBE FOR COLLECTING BROKEN ENDS OF YARN AT THE OUTLET OF A TEXTILE MACHINE

BACKGROUND OF THE INVENTION

The present invention relates to textile machines and more particularly to a suction tube for a fly frame, roving frame, ring spinning machine or like textile machine for collecting broken ends of yarn at the outlet rollers of the machine, wherein the suction tube is connected at one end to a collection chamber through flexible sealing sleeve that permits the suction tube to pivot between an operative position with the suction end of the tube proximal the outlet rollers and an inoperative position with the suction end spaced from the outlet rollers.

Conventional suction tubes generally have suction ends with unshielded openings such that air is not confined to only the path of the yarn, but is drawn from all directions into the opening at the bottom roller of the outlet rollers. In order to insure the necessary suction to draw yarn in from the yarn path and to draw in loose fibers and yarn ends from the periphery of the bottom roller, conventional systems require substantially greater suction capacity than would be necessary where the suction is confined to the yarn path and the periphery of the bottom roller.

Prior suction tubes with suction openings having particular shapes are disclosed in French Patent FR-PS 965 216 and Japanese Application SHO-39-16212. These prior suction tubes, while having specially shaped suction openings to improve the suction effect, still have spacings between the suction openings and the bottom rollers that require a substantial suction capacity to be effective.

The suction tube of the present invention generally overcomes the disadvantages of the prior art as the suction tube confines suction to the yarn path and the periphery of the bottom roller thus reducing the suction capacity required and can be positioned in close proximity to the rotating bottom roller further reducing the suction capacity required, without the possibility of damage resulting to the tube should it be inadvertently forced upwardly against the bottom roller.

SUMMARY OF THE INVENTION

Briefly described, the suction tube of the present invention comprises a suction end disposed under the bottom roller of the outlet rollers and having a body portion formed with an opening therein, an opposite end connected to a collection chamber through a flexible sealing sleeve, and a pair of side walls projecting from the suction end body portion beyond the suction opening for confining the path of suction to the opening, thus preventing the suction of air from directions where suction serves no purpose. The suction tube concentrates the path of suction on the path of the traveling yarn and on the area of the bottom roller periphery where loose fibers of the drawn fibers strand passing over the bottom outlet roller can adhere.

The side walls project beyond the body portion of the suction tube preferably upwardly toward the bottom roller to confine the path of suction at the bottom roller and provide a spacing between the body portion and the bottom roller to permit air flow therebetween to the suction opening in a direction opposite to the direction of rotation of the bottom roller for enhanced removal of loose fiber and broken ends adhering to the bottom roller.

The side walls also preferably project longitudinally beyond the suction opening on opposite sides of the yarn path for confining the suction substantially to the yarn path.

Further advantages of the suction tube with side walls having this configuration are that the cross-sectional area of the suction opening can be reduced and the necessary volume of air required to be suctioned is diminished since the suction is concentrated, resulting in increased energy efficiency of the system.

In the preferred embodiment of the present invention, the side walls have upper edges which are arcuately shaped to correspond approximately to the shape of the bottom roller of the outlet rollers. In this fashion, the side walls are adapted to conform to the roller for confining suction and serve to contact the rotating bottom roller for spacing the body portion of the suction tube from the roller when the suction tube is unintentionally forced upwardly toward the bottom roller, thereby preventing damage to the suction tube.

In the preferred embodiment of the present invention, a gripping portion is provided which projects generally downwardly from the suction end and rearwardly toward the opposite end of the suction tube at an acute angle relative to the longitudnal extent of the suction tube. The gripping portion permits engagement of the suction tube for manipulation between the operative and inoperative positions and also enhances suction flow to the opening.

Preferably, the suction opening is substantially rectangularly shaped and has rounded top and bottom edges for aerodynamic shaping. The advantage of these rounded edges is that the suction effect is improved with a low volume of air flow into the suction opening due to its aerodynamic shape, resulting in greater efficiency.

Other and further features and advantages of the present invention will be apparent from the accompanying drawings and the following detailed description of the preferred embodiment.

DESCRIPTION OF THE PREFERRED EMBODIMENT

Figure 1:
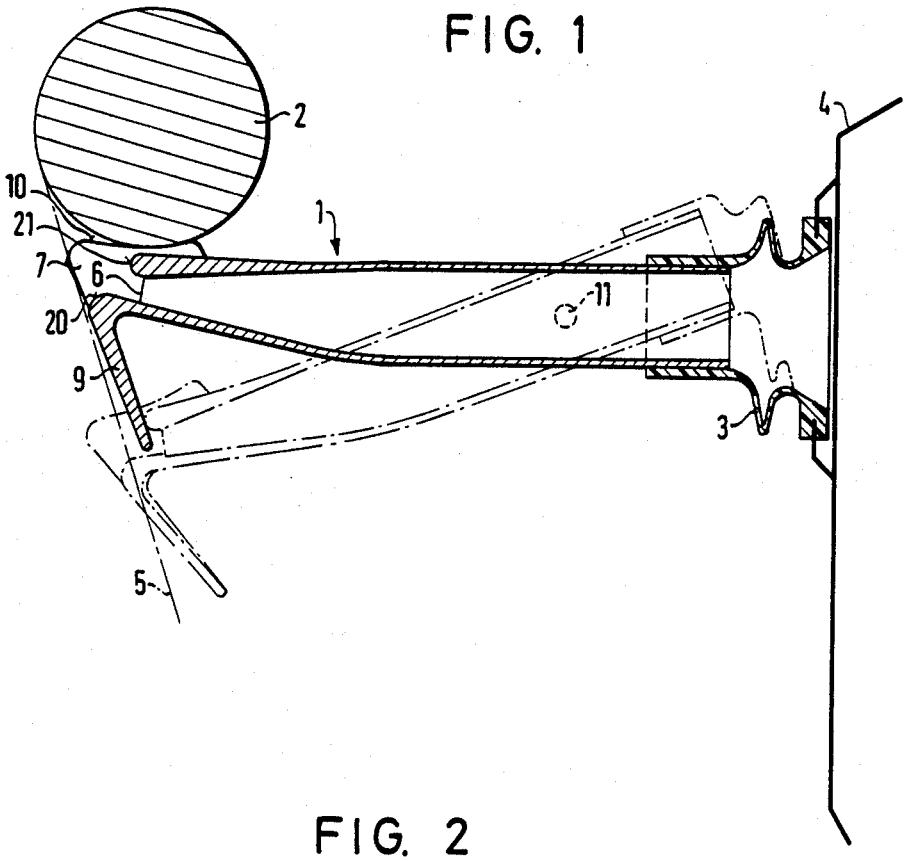
FIG. 1 is a vertical cross-sectional view of the bottom roller of a pair of outlet rollers or a textile machine with a cross-sectional view of a collection chamber and a suction tube according to the preferred embodiment of the present invention.

Referring now in greater detail to the accompanying drawings and initially to FIG. 1, an individual suction tube 1 for collecting broken ends of yarn is shown positioned below the bottom roller 2 of a pair of outlet rollers (not shown) of a fly frame, roving frame, ring spinning machine or like textile machine. A yarn 5 normally runs continuously from the bottom roller 2 past the suction end of the tube 1.

The suction tube 1 comprises a tubular body which is connected to a collection chamber 4 through a flexible sealing sleeve 3. The suction end of the tube 1 proximal the bottom roller 2 and the path of the traveling yarn 5 is directed slightly upwardly at an angle toward the bottom roller 2 and has a suction opening 6 formed therein. The suction opening 6 is rectangular and has rounded top and bottom edges 20,21 structured to draw air from the bottom roller 2 and the path of the traveling yarn 5 into the suction opening 6.

The suction end of the tube 1 also includes a pair of side walls 7,8 which project from the tubular body toward the bottom roller 2 on both sides of the suction opening 6 to confine suction therebetween effectively to the roller. As best shown in FIG. 1, the side walls have upper edges 10,10' which are arcuately shaped to correspond approximately to the shape of the bottom roller 2 of the outlet rollers. These upper edges 10,10' act as skids and will contact the rotating bottom roller 2 as shown in FIG. 1 and space the body of the suction tube 1 and the opening 6 from the roller 2 when the suction tube is unintentionally forced upwardly toward the bottom roller 2. In this manner, the suction tube 1 is prevented from damage.

The spacing provided by the side walls 7,8 between the suction tube 1 and the bottom roller 2 permits air to flow therebetween to the suction opening 6 in a direction opposite to the direction of rotation of the bottom roller 2. This air flow will remove loose fibers and broken yarn ends which may otherwise adhere to the bottom roller 2.

Figure 2:
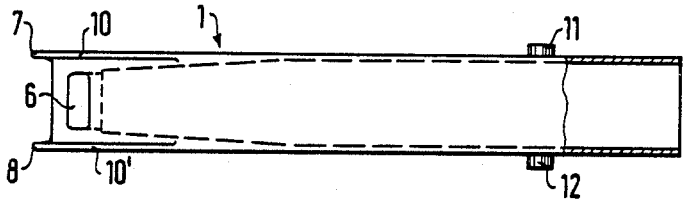
FIG. 2 is a plan view partially in section of the suction tube of FIG. 1.

The side walls 7,8 also project longitudinally beyond the suction opening 6 as best shown in FIG. 2 and will be disposed on opposite sides of the yarn path for confining the suction substantially to the yarn path. With the side walls 7,8 projectig with their upper edges 10,10' proximal the bottom roller 2 and on opposite sides of the yarn path, the suction of air is confined to the locations where it is needed, i.e. from the bottom roller and the yarn path into the suction opening. Thus, the cross-sectional area of the suction opening 6 can be reduced and the necessary volume of air flow into the suction opening 6 can be reduced, resulting in an overll increase in efficiency.

Figure 3:
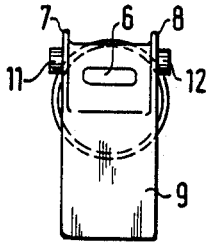
FIG. 3 is a front elevation of the suction tube of FIG. 1.

Referring now to FIGS. 1 and 3, a gripping portion 9 projects downardly from the suction end at an inclination therefrom. The gripping portion 9 extends integrally from the side walls 7,8 generally perpendicular to the planes of the side walls 7,8 making a smooth transition therefrom, and projects generally downwardly and rearwardly toward the flexible sealing sleeve 3 at an acute angle relative to the longitudinal extent of the suction tube 1. The gripping portion 9 interacts with the side walls 7,8 to facilitate concentration of the suction action on the yarn path and as described more fully below, facilitates engagement of the suction tube 1 for manipulation between its operative and inoperative positions.

The suction opening 6 is substantially rectangularly shaped, as shown in FIGS. 2 and 3, and as previously mentioned, has rounded top and bottom edges 20,21, as best shown in FIG. 1. The rounded edges 20,21 improve the efficiency of the suction effect by presenting an aerodynamic shape that does not cause disturbances in the air flow around the yarn path and the bottom roller 2.

The suction tube 1 includes a pair of diametrically opposite bushings 11,12 intermediate the suction end and the flexible sealing sleeve 4. The bushings 11,12 are received by a mounting arrangement (not shown) for the suction tube 1 which allows the bushings 11,12 to rotate to permit the suction tube 3 to pivot about an axis defined by the bushings 11,12 between its operative position (solid lines in FIG. 1) with the suction opening 6 proximal the bottom roller 2 and its inoperative position (dot-dash lines in FIG. 1) with the suction opening 6 spaced from the bottom roller 2. The gripping portion 9 previously described facilitates manipulation of the suction tube 1 between these positions.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A suction tube for a fly frame, roving frame, ring spinning machine or like textile machine for collecting broken ends of yarn at the outlet rollers of the machine and connected to a collection chamber through a flexible sealing sleeve that permits the suction tube to pivot between an operative position proximal the outlet rollers and an inoperative position spaced from said outlet rollers, said suction tube comprising:

a suction end disposed under a bottom roller of the outlet rollers and having a body portion formed with a suction opening therein, an opposite end connected to said flexible sealing sleeve, a pair of side walls affixed to and projecting from said suction end body portion beyond said suction opening for confining the path of suction to said opening, and a gripping portion projecting downwardly from said suction end at an inclination therefrom to facilitate engagement of said suction tube for manipulation between operative and inoperative positions.

2. A suction tube according to claim 1 and characterized further in that said side walls project upwardly toward the bottom roller to confine the path of suction at the bottom roller.

3. A suction tube according to claim 2 and characterized further in that said side walls project beyond said body portion to provide a spacing between said body portion and the bottom roller to permit air flow therebetween to said suction opening in a direction opposite to the direction of rotation of the bottom roller for enhanced removal of fibers and broken ends adhering to the bottom roller.

4. A suction tube according to claim 2 and characterized further in that said side walls are adapted to contact the rotating bottom roller and space said body portion from the roller when the suction tube is unintentionally forced upwardly toward the bottom roller, thereby preventing damage to the suction tube.

5. A suction tube according to claim 1, 2, 3 or 4 and characterized further in that said side walls have upper edges arcuately shaped to correspond approximately to the shape of the bottom roller of the outlet rollers.

6. A suction tube according to claim 1, 2, 3 or 4 and characterized further in that said side walls project longitudinally beyond said suction opening on opposite sides of the yarn path for confining the suction substantially to said yarn path.

7. An improved suction tube according to claim 1, 2 or 3 and characterized further in that said suction opening is substantially rectangularly shaped and has rounded top and bottom edges.

8. A suction tube according to claim 1 and characterized further in that said gripping portion projects generally downwardly and rearwardly toward said opposite end at an acute angle relative to the longitudinal extent of said suction tube.

* * * * *